US009360830B1

(12) United States Patent
Shokaku et al.

(10) Patent No.: US 9,360,830 B1
(45) Date of Patent: Jun. 7, 2016

(54) IMAGE FORMING APPARATUS HAVING A SUPPORT UNIT TO MOVE A LIGHT ELEMENT OF THE IMAGE FORMING APPARATUS

(71) Applicant: FUJI XEROX CO., LTD., Minato-ku, Tokyo (JP)

(72) Inventors: Hiroshi Shokaku, Kanagawa (JP); Kazuaki Iikura, Kanagawa (JP); Kaoru Watanabe, Kanagawa (JP); Kazuhiro Saito, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/804,987

(22) Filed: Jul. 21, 2015

(30) Foreign Application Priority Data

Mar. 16, 2015 (JP) ..... 2015-052469

(51) Int. Cl.
*G03G 21/16* (2006.01)

(52) U.S. Cl.
CPC ..... *G03G 21/1666* (2013.01)

(58) Field of Classification Search
CPC ..... G03G 15/326; G03G 15/043; G03G 15/04054; G03G 15/0435; G03G 2215/0409; G03G 15/26; G03G 21/1666; G03G 2215/0404; G03G 2221/1636; G03G 15/011
USPC ..... 399/4
See application file for complete search history.

(56) References Cited

U.S. PATENT DOCUMENTS

2008/0279585 A1* 11/2008 Furuichi ..... G03G 15/04036 399/118
2009/0142092 A1* 6/2009 Sato ..... G03G 21/1846 399/111
2009/0190953 A1* 7/2009 Okabe ..... G03G 21/1853 399/111
2010/0020301 A1* 1/2010 Sugiyama ..... B41J 2/45 355/67
2010/0021200 A1* 1/2010 Kato ..... G03G 21/1647 399/111
2010/0054802 A1* 3/2010 Sakai ..... G03G 15/326 399/116
2011/0299883 A1* 12/2011 Suzuki ..... G03G 15/0894 399/110
2015/0153705 A1* 6/2015 Sakaue ..... G03G 21/1666 347/118

FOREIGN PATENT DOCUMENTS

JP 2011-016364 A 1/2011

* cited by examiner

*Primary Examiner* — Francis Gray
(74) *Attorney, Agent, or Firm* — Sughrue Mion, PLLC

(57) ABSTRACT

An image forming apparatus includes a light emitting element unit disposed at an operating position closely opposed to a photoconductor in a printing operation and having a light emitting element that forms an image on the photoconductor, a support unit mounted in the image forming apparatus to support the light emitting element unit, and an elastic member disposed between the light emitting element unit and the support unit. In a state in which the light emitting element unit is disposed at the operating position, the support unit supports the light emitting element unit with the elastic member being disposed therebetween.

6 Claims, 7 Drawing Sheets

IMAGE FORMING APPARATUS HAVING A SUPPORT UNIT TO MOVE A LIGHT ELEMENT OF THE IMAGE FORMING APPARATUS

CROSS-REFERENCE TO RELATED APPLICATIONS

This application is based on and claims priority under 35 USC 119 from Japanese Patent Application No. 2015-052469 filed Mar. 16, 2015.

BACKGROUND (i) Technical Field

The present invention relates to an image forming apparatus.

(ii) Related Art

There has been known an image forming apparatus that performs printing by writing an image on a photoconductor through exposure of the photoconductor, attaching toner to the photoconductor along the image, transferring the attached toner onto a printing medium such as paper, and fixing the transferred toner on the printing medium.

As an exposure method for a photoconductor, there have been known a laser raster output scanner (ROS) method that scans light emitted from a laser light source by using a polygonal mirror and a method using a light emitting element unit including light emitting elements serving as a light source. As the method using the light emitting element unit as the light source, an LED print head method using light emitting diodes (LEDs) as the light source is known.

In the LED print head method, an LED print head including plural LEDs arranged in one direction is used. The LED print head is disposed at a position closely opposed to a photoconductor so that light emitted from the plural LEDs is focused on a surface of the photoconductor in a printing operation. At that position, the plural LEDs emit light toward the photoconductor to expose the photoconductor.

A photoconductor is a consumable member that needs to be periodically replaced. A typical photoconductor is combined with a charging unit for charging the photoconductor and a cleaning unit for removing residual toner on the photoconductor so as to constitute a photoconductor unit. It is general to replace the whole photoconductor unit. Further, a process unit is sometimes constituted by the photoconductor unit and a developing section (a combination of a developing unit for attaching toner to an image formed on the photoconductor and a toner supply unit for supplying toner to the developing unit), and the whole process unit is replaced.

As described above, since the LED print head is disposed at the position close to the photoconductor during a printing operation, it needs to be moved to a position apart from the photoconductor or the photoconductor unit so as not to interfere with the photoconductor or the photoconductor unit during replacement of the photoconductor.

SUMMARY

According to an aspect of the invention, there is provided an image forming apparatus including a light emitting element unit disposed at an operating position closely opposed to a photoconductor in a printing operation and having a light emitting element that forms an image on the photoconductor, a support unit mounted in the image forming apparatus to support the light emitting element unit, and an elastic member disposed between the light emitting element unit and the support unit. In a state in which the light emitting element unit is disposed at the operating position, the support unit supports the light emitting element unit with the elastic member being disposed therebetween.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described below with reference to the drawings.

Outline of Image Forming Apparatus of Exemplary Embodiment

Figure 1:
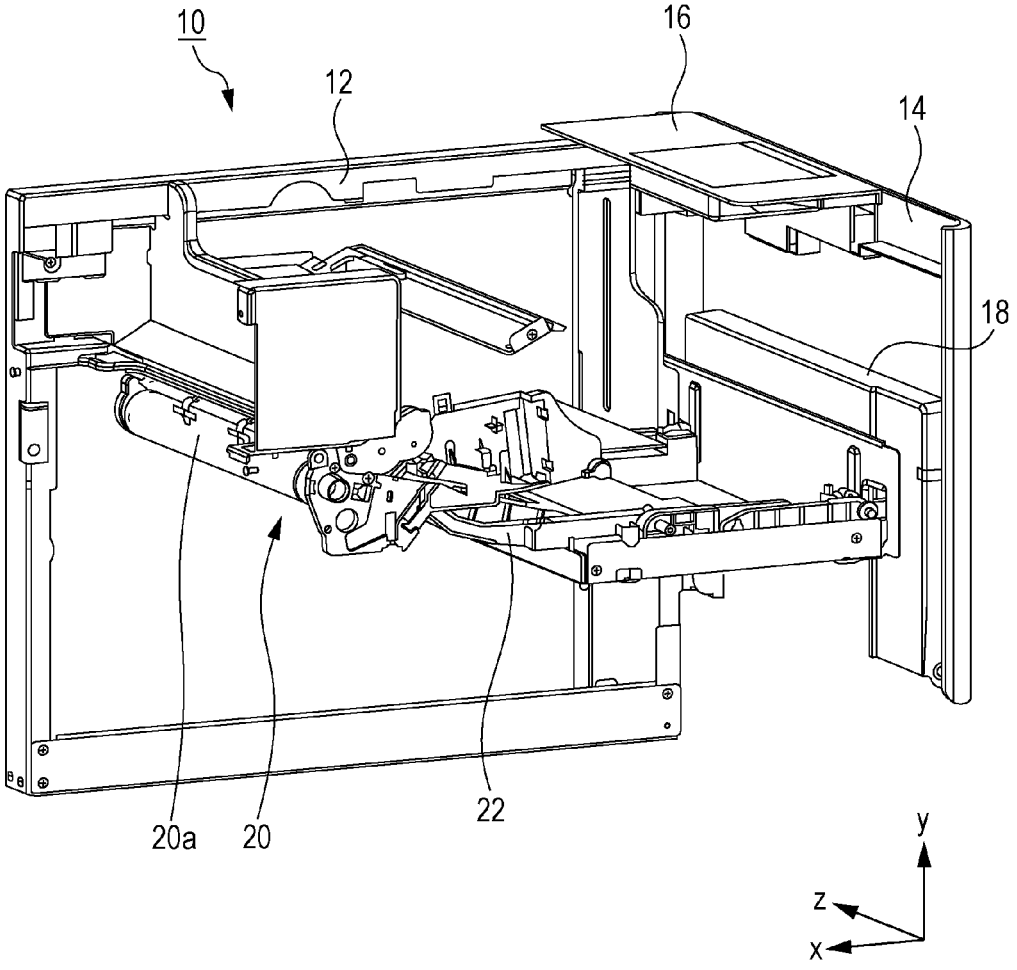
FIG. 1 is a schematic structural view of an image forming apparatus according to an exemplary embodiment.

FIG. 1 is a schematic structural view of an image forming apparatus 10 according to an exemplary embodiment. FIG. 1 illustrates only some of members included in the image forming apparatus 10. The image forming apparatus 10 includes a housing frame 12 formed of a rigid material, such as metal, to form a frame of the image forming apparatus 10, a front panel 14 formed of, for example, resin, an upper cover 16 similarly formed of, for example, resin, a front cover 18 similarly formed of, for example, resin, a process unit 20, an LED print head (not illustrated in FIG. 1) serving as an example of a light emitting element unit having light emitting elements, and a support unit 22 that supports the LED print head.

A surface provided with the front cover 18 is a front surface of the image forming apparatus 10, and a surface provided with the upper cover 16 is an upper surface of the image forming apparatus 10. In FIG. 1, the front-rear direction of the image forming apparatus 10 is referred to as an x-axis, the up-down direction of the image forming apparatus 10 is referred to as a y-axis, and the right-left direction of the image forming apparatus 10 that is perpendicular to the x-axis and the y-axis is referred to as a z-axis.

The process unit 20 is formed by a combination of a photoconductor unit and a developing unit. Specifically, in the process unit 20, a photoconductor drum 20*a*, a charging roller for charging the photoconductor drum 20*a*, a cleaning blade for removing residual toner on the photoconductor drum 20*a*, a toner container that contains toner, a developing roller for attaching the toner to an image on the photoconductor drum 20*a*, and a waste toner container that contains the toner removed by the cleaning blade are stored in a process unit housing.

The process unit 20 is a consumable article, and needs to be replaced periodically. The process unit 20 can be replaced by general users. In the exemplary embodiment, the process unit 20 is disposed in a somewhat rear part of the image forming apparatus 10, and the photoconductor drum 20*a* is located on the rearmost side in the process unit 20.

The image forming apparatus 10 is a monochrome printer, and includes one process unit 20. The present invention is, of course, applicable to a color printer or a color multifunction apparatus. In this case, a structure similar to that of the following exemplary embodiment is applied to process units corresponding to colors and LED print heads corresponding to the process units.

In addition to the above-described components, the image forming apparatus 10 includes a paper tray that contains paper serving as printing media, a paper feed belt that transports the paper from the paper tray, a paper feed roller that moves the paper feed belt, a transfer roller that transfers toner attached to the photoconductor drum 20*a* onto the paper, a fixing roller that fixes the toner transferred on the paper, a power supply unit that supplies power to the components, and a controller that controls the components. A printing operation is performed by cooperation of these components.

The support unit 22 is formed of a rigid material such as metal or high-rigidity resin. The concept of "rigid" in this specification includes not only a rigid body in a physical sense (that is, an object in which the distances between constituent elements are absolute) but also an object having the property such that the shape thereof hardly changes in normal use of the image forming apparatus 10. The support unit 22 is mounted inside the image forming apparatus 10 and supports the LED print head at a proper position.

Figure 2:
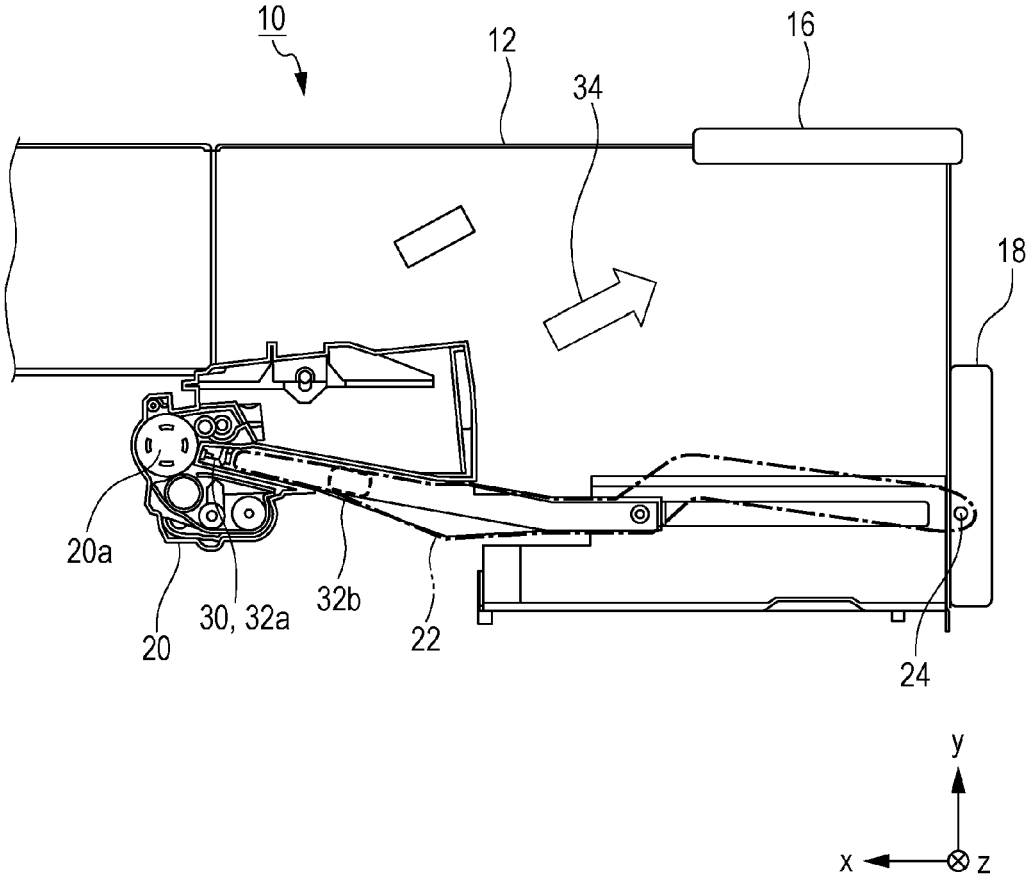
FIG. 2 illustrates the positional relationship between a process unit and an LED print head.

FIG. 2 is a side view of the process unit 20, an LED print head 30, the support unit 22, the upper cover 16, and the front cover 18. A part of the process unit 20 is illustrated in an x-y cross-sectional view. In FIG. 2, the process unit 20 is surrounded by a thick line, and the support unit 22 is surrounded by a one-dot chain line.

The support unit 22 is screwed and fixed to the front cover 18 at a front end portion 24. Therefore, the support unit 22 is shaped to extend in the front-rear direction from the forefront surface of the image forming apparatus 10 to a rear position (near the position of the photoconductor drum 20*a*) so that the LED print head 30 can be close to the photoconductor drum 20*a* located in the rear part of the image forming apparatus 10. Since the LED print head 30 is shaped like a bar extending in the z-axis direction, as will be described later, at least a part of the support unit 22 close to the LED print head 30 extends in the z-axis direction to properly support the LED print head 30. That is, at least a part of the support unit 22 is shaped like a plate. The LED print head 30 is supported by a rear end portion of the support unit 22.

The LED print head 30 includes plural LEDs arranged in one direction. The plural LEDs are arranged in the z-axis direction, and the LED print head 30 is shaped like a bar extending in the z-axis direction. The plural LEDs are provided so that the light emitting direction thereof is directed toward the photoconductor drum 20*a*. In a printing operation, the LED print head 30 is disposed at a position closely opposed to the photoconductor drum 20*a* such that light emitted from the plural LEDs is focused on the surface of the photoconductor drum 20*a*, that is, at an operating position 32*a*. FIG. 2 illustrates a state in which the LED print head 30 is located at the operating position 32*a*. At the operating position, the plural LEDs emit light to expose the photoconductor drum 20*a* and to thereby form an image to be developed.

As illustrated in FIG. 2, in the exemplary embodiment, the process unit 20 has a bent shape (U-shape) in the x-y cross section. The photoconductor drum 20*a* is disposed at a bent portion on the rearmost side of the process unit 20. Therefore, when the LED print head 30 is at the operating position 32*a*, it is disposed such as to be enveloped in the process unit 20 (that is, such that the process unit 20 is located on both upper and lower sides of the LED print head 30).

To replace the process unit 20, the user opens the front cover 18 and the upper cover 16, and then draws out the process unit 20 in a direction of arrow 34, that is, toward the upper front side of the image forming apparatus 10. Therefore, if the LED print head 30 stays at the operating position 32*a*, it interferes with the process unit 20 during replacement of the process unit 20. Therefore, the LED print head 30 is movable between the operating position 32*a* and a withdrawn position 32*b* (a position that is at a predetermined distance from the photoconductor drum 20*a* and that does not interfere with replacement of the process unit 20) along with movement of the support unit 22.

In the exemplary embodiment, the LED print head 30 moves in operative association with the opening and closing operation of the front cover 18. When the front cover 18 is moved in a −x-axis direction (that is, when the front cover 18 is opened), the support unit 22 screwed and fixed to the front cover 18 also moves in the −x-axis direction. Along with this movement of the support unit 22 in the −x-axis direction, the LED print head 30 supported by the support unit 22 also moves in the −x-axis direction. When the front cover 18 is brought into a completely open state, the LED print head 30 moves to the withdrawn position 32*b*. Similarly, when the front cover 18 is moved in a +x-axis direction (that is, when the front cover 18 is closed), the support unit 22 screwed and fixed to the front cover 18 also moves in the +x-axis direction. Along with this movement of the support unit 22 in the +x-axis direction, the LED print head 30 supported by the support unit 22 moves in the +x-axis direction. When the front cover 18 is brought into a completely closed state, the LED print head 30 moves to the operating position 32*a*. The moving direction or moving amount of the LED print head 30 in response to the opening and closing operation of the front cover 18 may be, of course, adjusted by the shape or structure of the support unit 22, for example, according to the shape of the process unit 20.

Since the LED print head 30 moves in operative association with the opening and closing operation of the front cover 18, the user may replace the process unit 20 more properly. When the process unit 20 is replaced, the front cover 18 is opened. Since the LED print head 30 moves to the withdrawn position 32*b* in operative association with the replacement operation, the user may replace the process unit 20 without performing another operation of withdrawing the LED print head 30.

The support unit 22 may be attached to a portion other than the front cover 18 as long as it properly supports the LED print head 30. For example, the support unit 22 may be attached to the housing frame 12. In this case, the user additionally performs an operation of moving the LED print head 30 between the operating position 32*a* and the withdrawn position 32*b* by using a lever or the like.

Support Structure for LED Print Head

In the exemplary embodiment, when the LED print head 30 is at the withdrawn position 32*b*, the support unit 22 fixedly supports the LED print head 30 (hereinafter, this state will be referred to as a "fixed state"). While the LED print head 30 is moving to the operating position 32*a* or after the LED print head 30 moves to the operating position 32*a*, the support unit 22 releases the support for the LED print head 30, and supports the LED print head 30 with an elastic member being disposed therebetween (hereinafter, this state will be referred to as a "released state"). A support structure of the support unit 22 for the LED print head 30 will be described below.

Figure 3:
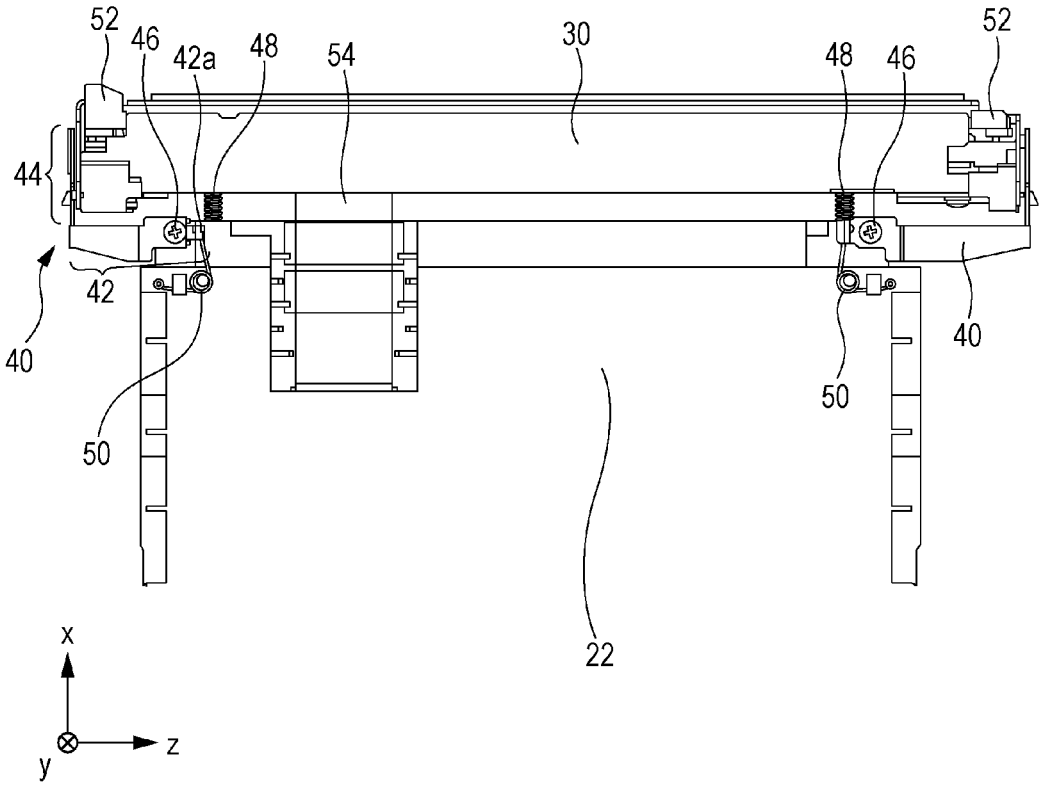
FIG. 3 is a plan view of the LED print head and a support unit.

FIG. 3 is a plan view of the support unit 22 and the LED print head 30. FIG. 3 illustrates a state in which the LED print head 30 is disposed at the withdrawn position 32*b*. That is, FIG. 3 illustrates the LED print head 30 and the support unit 22 in a fixed state.

A fixing member 40 fixes the LED print head 30 to the support unit 22. The fixing member 40 is formed of a rigid material such as metal or high-rigidity resin. In the exemplary embodiment, the fixing member 40 includes an arm portion 42 extending in the z-axis direction, that is, in the extending direction of the LED print head 30, and a plate-like side face portion 44 extending along a side surface of the LED print head 30. A portion of the arm portion 42 near a side end portion of the support unit 22 has a screw hole, and the fixing member 40 is attached to the support unit 22 by a screw 46. Further, the fixing member 40 supports the LED print head 30 in the side face portion 44. Thus, the support unit 22 supports the LED print head 30 with the fixing member 40 being disposed therebetween. Details of the fixing structure of the fixing member 40 for the LED print head 30 will be described later with reference to FIG. 4.

Plural fixing members 40 may be provided to properly support the bar-shaped LED print head 30. In the exemplary embodiment, the fixing member 40 is attached to each of the z-axis ends of the support unit 22.

A coil spring 48 serving as an elastic member is provided between the LED print head 30 and the support unit 22. While a force of separating the LED print head 30 and the support unit 22 is applied thereto by the coil spring 48, since the LED print head 30 is supported by the support unit 22 with the fixing member 40 being disposed therebetween in the fixed state, the LED print head 30 and the support unit 22 are not separated by the force of the coil spring 48. As will be described later, in a released state, the support of the fixing member 40 for the LED print head 30 is released, and the support unit 22 supports the LED print head 30 with the coil spring 48 being disposed therebetween. Therefore, plural coil springs 48 are provided in the z-axis direction so that the support unit 22 properly supports the LED print head 30 with the coil springs 48 being disposed therebetween. In the exemplary embodiment, two coil springs 48 are provided near two z-axis end portions of the support unit 22. Three or more coil springs 48 may be provided.

A torsion spring 50 is attached to the support unit 22. The torsion spring 50 is fixedly connected at one end to the support unit 22, and is connected at the other end to an end portion 42*a* (an end portion opposite from the side face portion 44) of the arm portion 42 in the fixing member 40. The action of the torsion spring 50 will be described later with reference to FIG. 4.

Abutting portions 52 are formed of a rigid material such as metal or high-rigidity resin. The abutting portions 52 are provided at two longitudinal ends of the LED print head 30 on a side opposite from the support unit 22. The abutting portions 52 are members that position the LED print head 30 relative to the photoconductor drum 20*a* in the released state. Details of a positioning method will be described later.

A flexible cable 54 is provided between the support unit 22 and the LED print head 30 to electrically connect the support unit 22 and the LED print head 30. Power is supplied to plural LEDs included in the LED print head 30 via the flexible cable 54.

Figure 4:
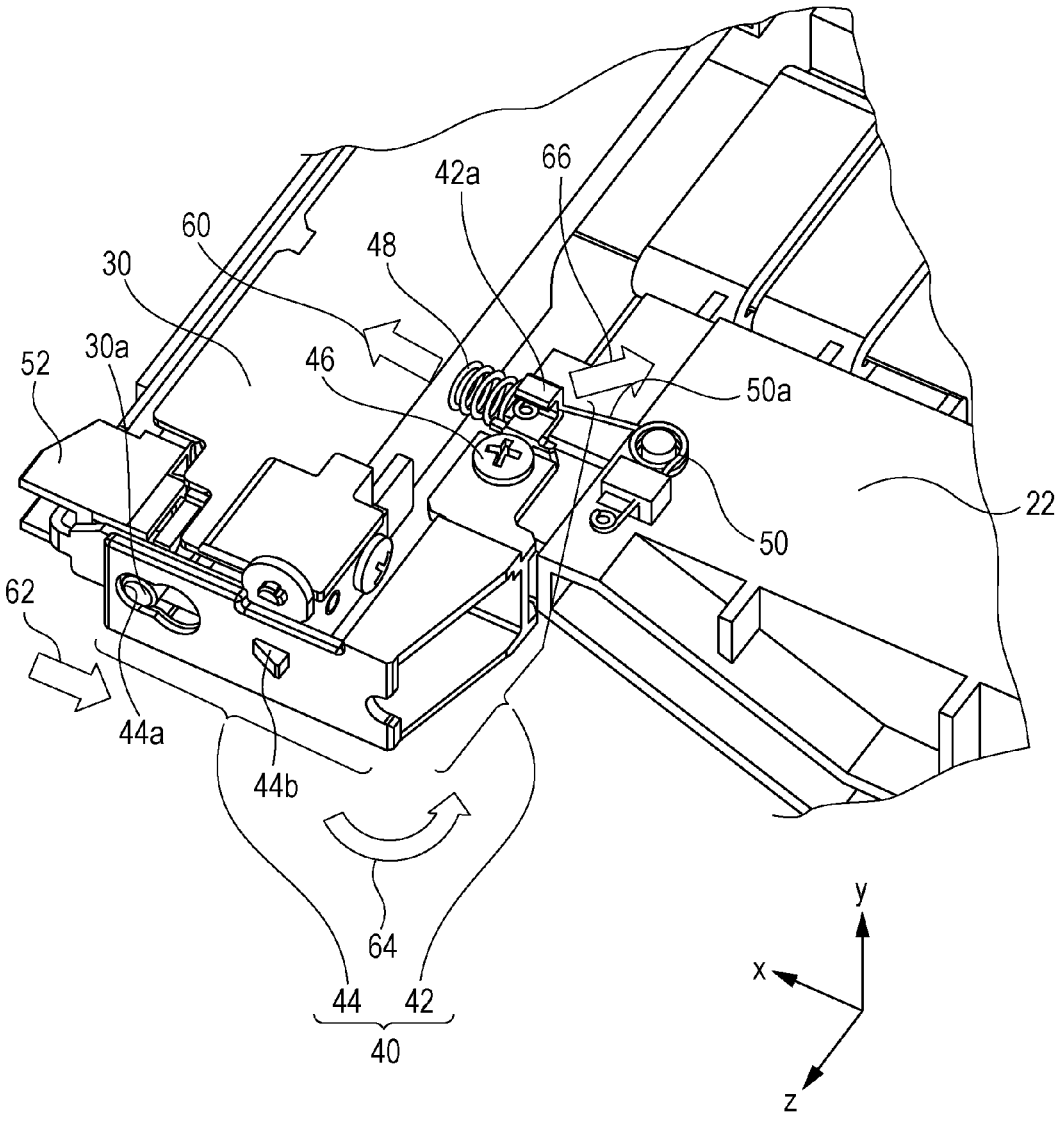
FIG. 4 illustrates a state in which the LED print head is fixed to the support unit.

FIG. 4 is an enlarged view of a connecting portion between the LED print head 30 and the support unit 22 in the fixed state. Since two fixing members 40 respectively provided at two end portions of the support unit 22 have similar structures and similarly operate, the following description will be given with a focus on one of the fixing members 40.

As illustrated in FIG. 4, a hole 44*a* is provided near an end portion on a rear side (a side opposite from the support unit 22) of the plate-like side face portion 44. The side surface of the LED print head 30 has a projection 30*a* having a shape corresponding to the hole 44*a*. By engagement of the projection 30*a* with the hole 44*a*, the LED print head 30 is supported by the fixing member 40. While the hole 44*a* and the projection 30*a* are circular in the x-y cross section in the exemplary embodiment, the shapes of the hole 44*a* and the projection 30*a* are not limited to the circular shape as long as the hole 44*a* and the projection 30*a* are engaged properly. Further, while the hole 44*a* is a through hole in FIG. 4, a hole with which the projection 30*a* engages does not always need to penetrate the side face portion 44, and it is only necessary that a recessed portion with which the projection 30*a* engages is provided in a surface of the side face portion 44 facing the LED print head 30.

Specifically, the following force acts on the LED print head 30. As described above, in the fixed state, a force is applied to the LED print head 30 in a direction of arrow 60, that is, in a direction to be separated from the support unit 22 by the coil spring 48. In contrast, the fixing member 40 is attached to the support unit 22, and the projection 30*a* of the LED print head 30 is engaged with the hole 44*a* provided in the side face portion 44 of the fixing member 40. Hence, a force in a direction of arrow 62 (that is, a force reacting against the restoring force of the coil spring 48) is applied to the LED print head 30 by the fixing member 40. Then, the force of the coil spring 48 in the direction of arrow 60 and the force of the fixing member 40 in the direction of arrow 62 balance each other, and the LED print head 30 is fixedly supported by the support unit 22. That is, the LED print head 30 is fixed to the support unit 22 by cooperation of the coil spring 48, the fixing member 40, and the projection 30*a* provided on the side surface of the LED print head 30, and these components serve as a fixing unit.

While the fixing member 40 is attached to the support unit 22 by the screw 46, it is not completely fixed, but can turn on the screw 46 in a direction of arrow 64. That is, the fixing member 40 can turn in a direction such that the side face portion 44 moves away from the side surface of the LED print head 30. As will be described later, the fixed state is released by the turn of the fixing member 40. The support unit 22 is provided with the torsion spring 50 that applies, to the fixing member 40, a force of preventing the fixing member 40 from turning in the release direction so that the projection 30*a* is not disengaged from the hole 44*a* by an unexpected turn in the fixed state.

The torsion spring 50 is fixed at one end to the support unit 22 and is connected at the other end to the arm portion 42 of the fixing member 40. The restoring force of the torsion spring 50 acts on the end portion 42*a* of the arm portion 42, and a force in a direction of arrow 66 is applied to the end portion 42*a*. The force in the direction of arrow 66 is a force of turning the fixing member 40 in a direction opposite from the release direction (the direction of arrow 64), that is, a force of pressing the fixing member 40 against the side surface of the LED print head 30.

A projecting portion 44*b* is provided on the side face portion 44 of the fixing member 40. The projecting portion 44*b* is used when the fixing member 40 is turned in the direction of arrow 64, that is, when the fixed state of the LED print head 30 is released.

Figure 5:
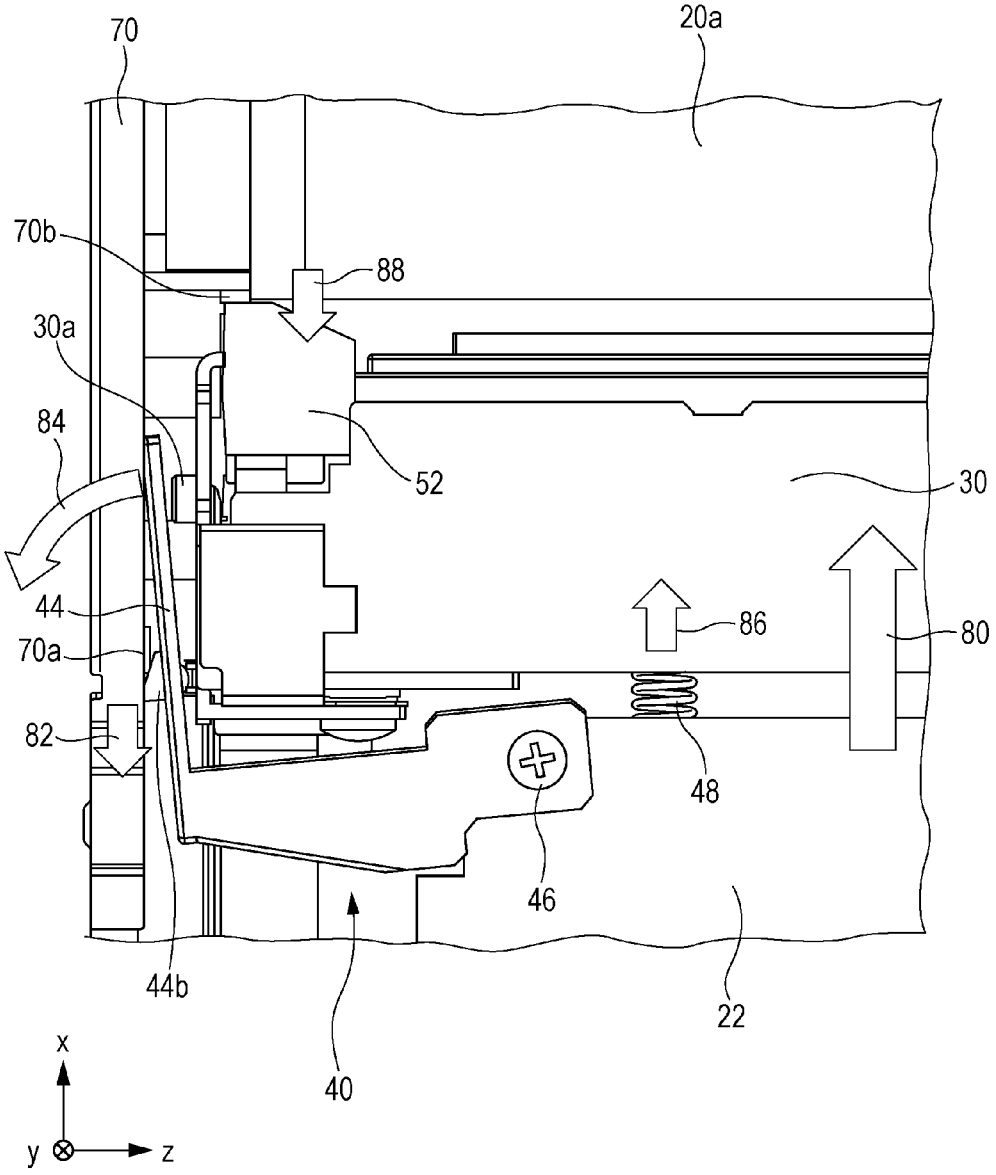
FIG. 5 illustrates a state in which fixing of the LED print head is released.

FIG. 5 is a plan view of the LED print head 30, the support unit 22, and the fixing member 40 in the released state. FIG.

5 illustrates the positional relationship between the LED print head 30 and the process unit 20 (in particular, the photoconductor drum 20*a* and a process unit housing 70).

At the time of replacement of the process unit 20, the LED print head 30 is moved from the withdrawn position 32*b* (see FIG. 2) to the operating position 32*a* after a new process unit 20 is set at a predetermined position. Arrow 80 in FIG. 5 represents the moving direction of the LED print head 30. In FIG. 5, the process unit 20 including the photoconductor drum 20*a* and the process unit housing 70 is set at a predetermined position and is in a stationary state. As the support unit 22 moves in the direction of arrow 80, the LED print head 30 and the fixing member 40 move closer to the photoconductor drum 20*a*. That is, the LED print head 30, the support unit 22, the fixing member 40, etc. move relative to the process unit 20.

In the exemplary embodiment, while the LED print head 30 is moving from the withdrawn position 32*b* to the operating position 32*a*, the fixing of the LED print head 30 by the fixing member 40 is released, and a released state is brought about. The operation of releasing the fixing of the LED print head 30 will be described below.

Inside the image forming apparatus 10, a projection is provided at a position along a moving path of the fixing member 40 (specifically, the projecting portion 44*b* of the fixing member 40) that moves along with movement of the LED print head 30 from the withdrawn position 32*b* to the operating position 32*a*. The projection interferes with the projecting portion 44*b*. The projection is provided at the position along the moving path of the projecting portion 44*b*, and may be disposed at any position inside the image forming apparatus 10 as long as it interferes with the projecting portion 44*b*. In the exemplary embodiment, since the process unit housing 70 extends along the moving path of the fixing member 40, as illustrated in FIG. 5, it has a projection 70*a* that interferes with the projecting portion 44*b*.

When the LED print head 30 is moved from the withdrawn position 32*b* to the operating position 32*a* by the movement of the support unit 22, the fixing member 40 also moves toward the photoconductor drum 20*a* along the process unit housing 70. When the fixing member 40 reaches the position of the projection 70*a* provided on the process unit housing 70, the projecting portion 44*b* provided on (the side face portion 44 of) the fixing member 40 interferes with the projection 70*a* on the process unit housing 70.

The fixing member 40 continues to move in the direction of arrow 80 even after the projection 70*a* interferes with the projecting portion 44*b*. Then, the projecting portion 44*b* is pressed by the projection 70*a*, and the fixing member 40 receives a force in a direction of arrow 82. Since the fixing member 40 is attached to turn on the screw 46, the force in the direction of arrow 82 serves as the force of turning the fixing member 40 in the direction of arrow 84. That is, the fixing member 40 receives, from the projecting portion 70*a*, a force such that the side face portion 44 of the fixing member 40 separates from the side surface of the LED print head 30.

By the turn of the fixing member 40 in the direction of arrow 84, the projection 30*a* provided on the side surface of the LED print head 30 disengages from the hole 44*a* (not illustrated in FIG. 5) provided in the side face portion 44 of the fixing member 40, and the support of the fixing member 40 for the LED print head 30 is released. As described above, the fixing of the fixing member 40 for the LED print head 30 is released by cooperation of the projection 70*a* provided on the process unit housing 70 and the projecting portion 44*b* provided on the fixing member 40. That is, the projection 70*a* and the projecting portion 44*b* function as a fixing release unit.

When the support of the fixing member 40 for the LED print head 30 is released, the LED print head 30 is moved toward the photoconductor drum 20*a* by the restoring force of the coil spring 48 (force in the direction of arrow 86). Then, the abutting portions 52 provided in the LED print head 30 abuts on an abutted portion provided inside the image forming apparatus 10, so that the LED print head 30 is positioned. As a matter of course, the position of the LED print head 30 determined by the abutting portion and the abutted portion is such that light emitted from the plural LEDs included in the LED print head 30 is focused on the surface of the photoconductor drum 20*a*.

The abutted portion may be provided in any member as long as the LED print head 30 is properly positioned by abutment of the abutting portion 52 thereon. In the exemplary embodiment, an abutted portion 70*b* is provided in the process unit housing 70.

As illustrated in FIG. 5, when the LED print head 30 is at the operating position 32*a*, the fixing support of the fixing member 40 for the LED print head 30 is released, that is, a released state is brought about. In this state, the support unit 22 supports the LED print head 30 with the coil spring 48 being disposed therebetween.

In the released state illustrated in FIG. 5, when the front cover 18 is opened for replacement of the process unit 20 and the support unit 22 is thereby moved in the direction away from the photoconductor drum 20*a* (that is, in the direction opposite from the direction of arrow 80), the fixing member 40 is also moved in the direction opposite from the direction of arrow 80. Then, the projection 70*a* and the projecting portion 44*b* separate, and the force received by the fixing member 40 from the projection 70*a* does not act. Further, the force of turning the fixing member 40 in the direction opposite from the direction of arrow 84, that is, the force of pressing the side face portion 44 against the side surface of the LED print head 30 is exerted by the action of the torsion spring 50 (not illustrated in FIG. 5, see FIG. 4), and the fixing member 40 turns so that the side face portion 44 moves toward the side surface of the LED print head 30. Thus, the projection 30*a* provided on the side surface of the LED print head 30 and the hole 44*a* provided in the side face portion 44 are engaged again, and this brings about a fixed state again. In this way, in the exemplary embodiment, the released state and the fixed state are switched in association with the movement of the LED print head 30 between the operating position 32*a* and the withdrawn position 32*b*.

The shape of the fixing member 40 is not limited to the above-described shape, and the fixing member 40 may have any shape as long as the LED print head 30 can be fixed to the support unit 22 and the fixing can be released by a simple operation.

Modification

Figure 6:
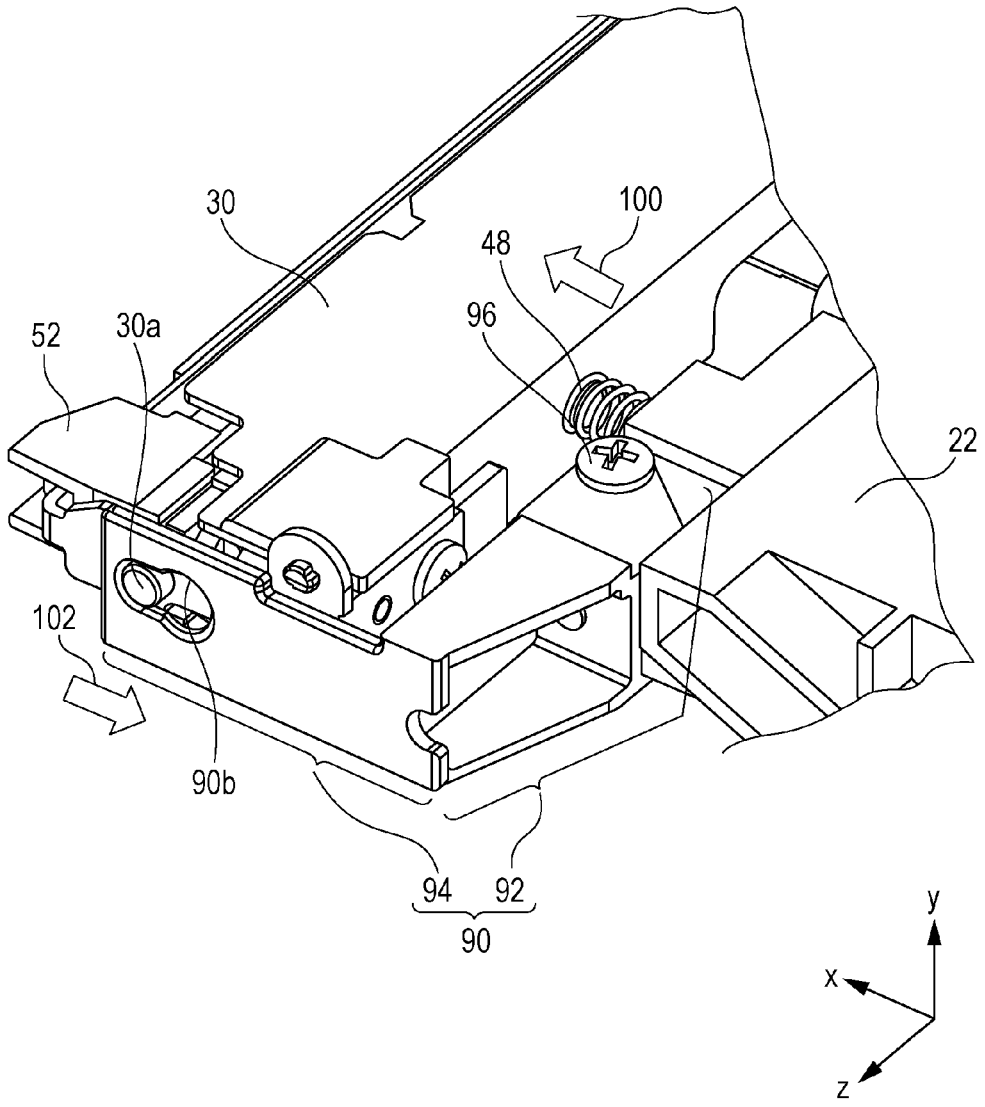
FIG. 6 illustrates a modification of a fixing member.

FIG. 6 illustrates a modification of a fixing member that fixes a LED print head 30 to a support unit 22. The modification is similar to the above-described exemplary embodiment except for the shape of the fixing member, the method for attaching the fixing member to the support unit 22, and the method for releasing fixing.

In the modification, the LED print head 30 is also fixed to the support unit 22 by a fixing member 90 in a fixed state, similarly to the above-described exemplary embodiment. The fixing member 90 is formed of a rigid material such as metal or high-rigidity resin, similarly to the fixing member 40 of the exemplary embodiment, and includes an arm portion 92 extending in the extending direction of the LED print head 30 and a plate-like side face portion 94 extending along a side surface of the LED print head 30. A screw hole is provided in an end portion of the arm portion 92 close to the support unit 22, and the fixing member 90 is attached to the support unit 22 by a screw 96.

In the modification, the fixing member 90 is completely fixed to the support unit 22 by the screw 96. The fixing member 90 does not turn relative to the support unit 22, but is combined with the support unit 22. A method for fixing and supporting the LED print head 30 by the fixing member 90 is similar to that adopted in the exemplary embodiment. That is, a force in a direction of arrow 100 is applied from a coil spring 48 to the LED print head 30. On the other hand, since a projection 30*a* of the LED print head 30 is engaged with a hole 90*b* provided in the side face portion 94 of the fixing member 90, a force in a direction of arrow 102 is applied from the fixing member 90 to the LED print head 30. The force in the direction of arrow 100 from the coil spring 48 and the force in the direction of arrow 102 from the fixing member 90 balance each other, and the LED print head 30 is thereby fixedly supported by the support unit 22.

In the modification, the hole 90*b* provided in the side face portion 94 of the fixing member 90 extends in the front-rear direction of the side face portion 94 (that is, the extending direction of the side face portion 94 toward the support unit 22 when viewed from the LED print head 30) so that the projection 30*a* provided on the side surface of the LED print head 30 can move within the hole 90*b* in the front-rear direction.

Figure 7:
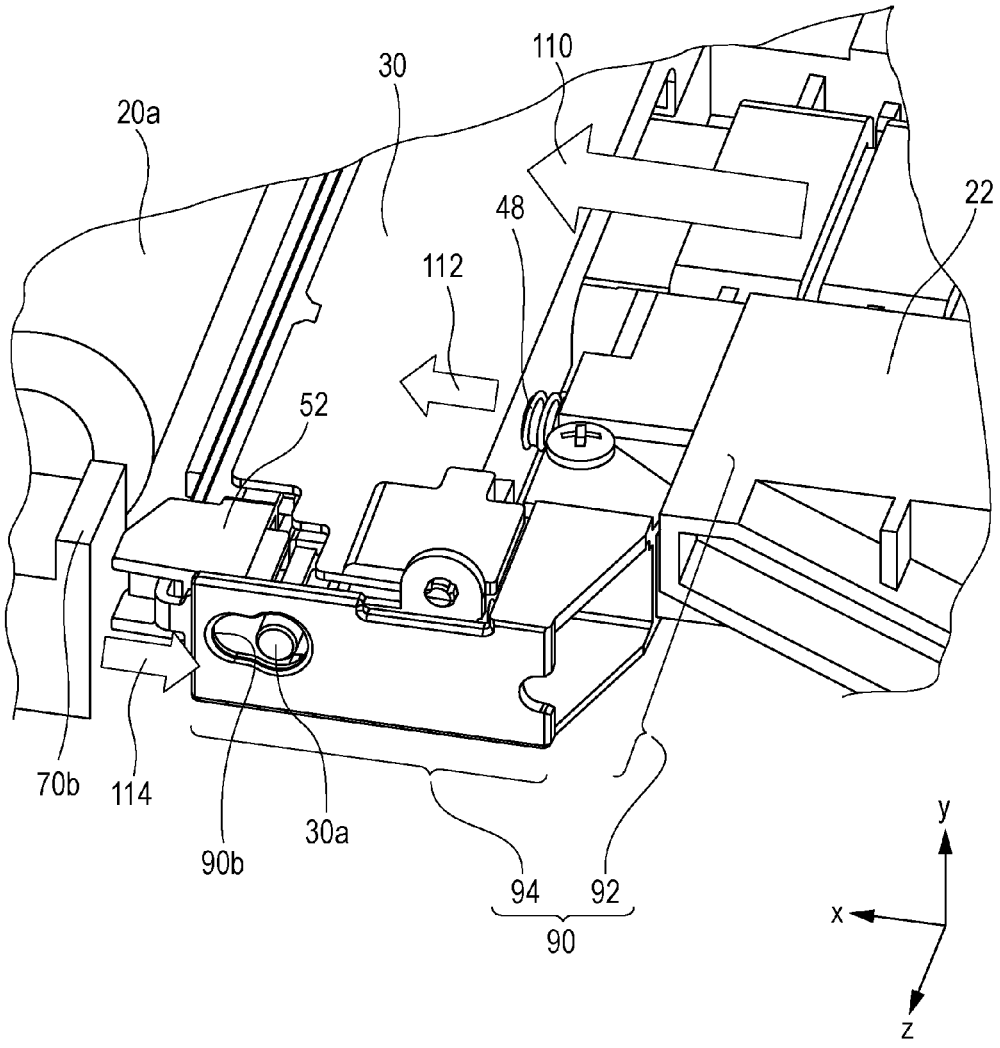
FIG. 7 illustrates a state in which fixing of an LED print head is released in the modification.

FIG. 7 illustrates a state in which fixing of the LED print head 30 is released in the modification. The LED print head 30 is moved in a direction of arrow 110 of FIG. 7 from a withdrawn position 32*b* (see FIG. 2) to an operating position 32*a*. In the modification, when the LED print head 30 moves to the operating position 32*a*, an abutting portion 52 first comes into contact with an abutted portion 70*b*.

When the support unit 22 is further moved in the direction of arrow 110 in this state, since the LED print head 30 abuts on the abutted portion 70*b*, the position thereof does not change further, but the support unit 22 and the fixing member 90 combined therewith further move in the direction of arrow 110. At this time, the coil spring 48 is compressed to allow movement of the support unit 22 and the fixing member 90.

Thus, the relative position between the LED print head 30 and the fixing member 90 changes, and the projection 30*a* provided on the side surface of the LED print head 30 moves within the hole 90*b*, and is suspended within the hole 90*b*. That is, the projection 30*a* and the hole 90*b* are out of contact, and the LED print head 30 is not supported by the fixing member 90. Therefore, in the state of FIG. 7, the support unit 22 supports the LED print head 30 with the coil spring 48 being disposed therebetween. That is, a released state is brought about. In this state, the restoring force of the coil spring 48 in a direction of arrow 112 and the force from the abutted portion 70*b* in a direction of arrow 114 balance each other.

When the support unit 22 is moved from the state of FIG. 7 in the direction opposite from the direction of arrow 110, for example, by opening a front cover 18 for replacement of a process unit 20, the fixing member 90 also moves in the direction opposite from the direction of arrow 110. Then, the projection 30*a* is engaged with the hole 90*b* again to shift the state to a fixed state again.

While the state is switched from the fixed state to the released state immediately before the LED print head 30 moves to the operating position 32*a* in the above-described exemplary embodiment, in the modification, the state is switched from the fixed state to the released state after the LED print head 30 moves to the operating position 32*a*.

Other Modifications

As described above, according to the exemplary embodiment, vibration occurring in the image forming apparatus 10 is absorbed by the coil spring 48 serving as the elastic member in the printing operation. The elastic member is not limited to the coil spring 48, and may be another member which can absorb vibration from the support unit 22 to the LED print head 30 and with which the LED print head 30 can be supported by the support unit 22. For example, the elastic member may be formed of elastic resin such as rubber.

While the state is switched from the fixed state to the released state along with the movement of the LED print head 30 from the withdrawn position 32*b* to the operating position 32*a* in the above exemplary embodiment, it may be switched from the fixed state to the released state by user operation. In this case, for example, a lever for switching between the fixed state and the released state is prepared separately. The user may switch the state to the released state by operating the lever after moving the LED print head 30 to the operating position 32*a* through the operation of closing the apparatus body cover. To replace the process unit, the user switches the state to the fixed state by operating the lever, and then moves the LED print head 30 to the withdrawn position 32*b* by opening the apparatus body cover. However, the method for switching the state from the fixed state to the released state along with movement of the LED print head 30 from the withdrawn position 32*b* to the operating position 32*a*, as in the exemplary embodiment, is more suitable because the user is not forced to perform another operation of switching between the fixed state and the released state.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a light emitting element unit disposed at an operating position closely opposed to a photoconductor in a printing operation and having a light emitting element configured to form an image on the photoconductor;

a support unit mounted in the image forming apparatus configured to support the light emitting element unit;

an elastic member disposed between the light emitting element unit and the support unit;

a fixing unit configured to fix the light emitting element unit to the support unit; and a fixing release unit configured to release the light emitting element unit from the fixing unit in response to the light emitting unit being disposed at the operating position such that the fixing unit is not in contact with the light emitting element unit, wherein, in response to the light emitting element unit being disposed at the operating position, the support unit is configured to support the light emitting element unit with the elastic member being disposed therebetween.

2. The image forming apparatus according to claim 1, wherein the light emitting element unit is movable between the operating position and a withdrawn position at a predetermined distance from the photoconductor along with movement of the support unit, wherein the fixing unit fixes the light emitting element unit to the support unit in a state in which the light emitting element unit is disposed at the withdrawn position, and wherein the fixing release unit releases the fixing of the light emitting element unit along with movement of the light emitting element unit from the withdrawn position to the operating position.

3. The image forming apparatus according to claim 1, in response to the light emitting element unit being disposed at the operating position, the fixing unit is completely disengaged from the light emitting unit.

4. The image forming apparatus according to claim 1, wherein the fixing member comprises:

a pair of arms extending in a direction toward the light emitting unit, wherein the pair of arms contact the light emitting unit, and in response to the light emitting element unit being disposed at the operating position, the pair of arms disengage from the light emitting unit.

5. The image forming apparatus according to claim 4, wherein the pair of arms rotate in a direction outward and away from the light emitting unit.

6. The image forming apparatus according to claim 4, wherein the light emitting unit comprises:

a pair of projections on opposite ends of the light emitting unit, wherein the pair of arms engage the pair of projections in response to the light emitting unit being in a withdrawn position which is a position away from the photoconductor.

* * * * *